United States Patent [19]

Varmuza

[11] 4,161,915

[45] Jul. 24, 1979

[54] ADJUSTABLE TABLE

[75] Inventor: Milan J. Varmuza, London, England

[73] Assignee: Avalanche Limited, London, England

[21] Appl. No.: 916,786

[22] Filed: Jun. 19, 1978

[30] Foreign Application Priority Data

Jul. 19, 1977 [GB] United Kingdom ..... 30179/77

[51] Int. Cl.[2] ..... A47B 9/00

[52] U.S. Cl. ..... 108/144; 248/188.2; 108/12

[58] Field of Search ..... 108/144, 145, 148, 96, 108/106, 12; 248/188.2

[56] References Cited

U.S. PATENT DOCUMENTS

| | | | |
|---|---|---|---|
| 2,398,693 | 4/1946 | Bureau | 108/144 X |
| 2,532,766 | 12/1950 | Galleret | 108/145 |
| 2,544,229 | 3/1951 | Hoppe | 108/145 |
| 2,602,011 | 7/1952 | Sanders | 108/12 |
| 2,630,360 | 3/1953 | McGinley | 108/144 X |
| 3,244,124 | 4/1966 | Accarino et al. | 108/12 |

FOREIGN PATENT DOCUMENTS

| | | | |
|---|---|---|---|
| 880030 | 12/1942 | France | 108/12 |

*Primary Examiner*—James T. McCall

*Attorney, Agent, or Firm*—Fleit & Jacobson

[57] ABSTRACT

An adjustable table comprising a pair of support members which are each pivotable from a first position in which they support a table top at a first height to a second position in which they support the table top at a second and higher height.

5 Claims, 6 Drawing Figures

ADJUSTABLE TABLE

This invention provides an adjustable table.

Accordingly, this invention provides an adjustable table comprising a pair of support members which are each pivotable from a first position in which they support a table top at a first height to a second position in which they support the table top at a second and higher height.

The adjustable table of the invention is thus a single table which can be used for two different purposes or occasions, whilst only occupying the space of a single table. Thus, for example, at the lower height of the table top, the table can be used as a coffee table and at the higher height of the table top, the table can be used as a dining table. Furthermore, the adjustable table of the invention can be so designed that it is not necessary to remove the table top when converting the table from one height to the other and vice versa. With appropriate designing, the support members can be moved between their two positions, with the table top in place, with a minimum of effort so that even elderly persons can easily effect the conversion.

Usually, the support members are substantially horizontal in the first position, and the support members are then substantially vertical in the second position.

The support members are preferably square but they can be other shapes, for example rectangular, if desired. The length of the support members determines the relative heights of the table top in its upper and lower positions.

Preferably, the table top freely rests on the support members and is not secured to the support members. The support members may be provided with stops on which the table top rests. The stops can be made from any material that does not abraid the table top. Thus, for example, the stops can be made of a plastics material.

The table can be constructed in various designs and shapes. Thus, the table may have a pair of legs at each end, each support member than being pivotally supported between the upper end portions of the two legs of each pair of legs. Preferably, the legs are connected by a central support bar positioned at floor level.

The support members may pivot on bolts positioned in the upper end portions of the table legs. The bolts can be made from various materials, it presently being preferred to make the bolts, or at least their visible heads, of chrome, brass or chrome-covered metal.

Preferably, the adjustable table of the invention is provided with locking means for locking the support members in their second position. The locking means may be locking bolts positioned in the table legs beneath the pivot bolts. Locking means may also be provided for locking the support members in their first position.

The support members are preferably constructed as an open framework, although they can be solid if desired. The open framework construction will usually be lighter and therefore easier to manipulate. The open framework can be of tubular construction, the tubes preferably being of square or rectangular cross-section. The support members, pivots and the other table structure may be made of rigid plastics materials, wood or metal. The metal should have a pleasing appearance and it may thus be of brass, chrome covered steel, brushed aluminium, or a plastics covered metal.

The table top can be made of various materials, it presently being preferred to employ glass. Examples of other materials for the table top are wood and metal sheets. The type of material chosen for the table top will obviously depend to a large extent upon the intended use of the table.

An embodiment of the invention will now be described solely by way of example and with reference to the accompanying drawings in which.

Figure 1:
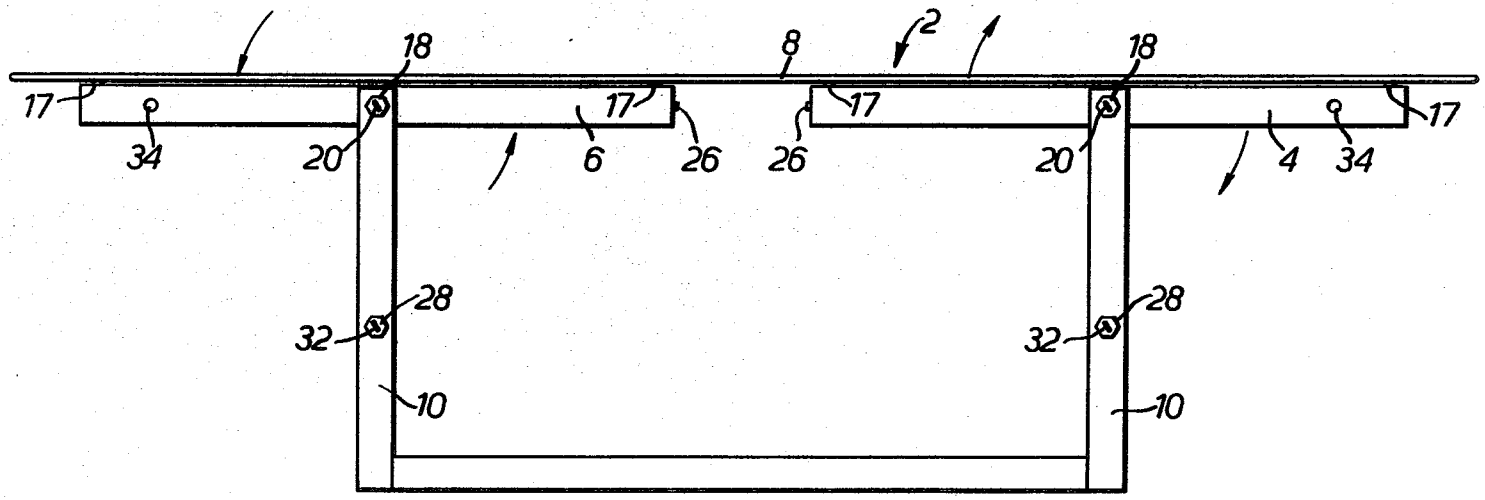
FIG. 1 is a side view of a table in accordance with the invention with the table top in its lower position.
Figure 2:
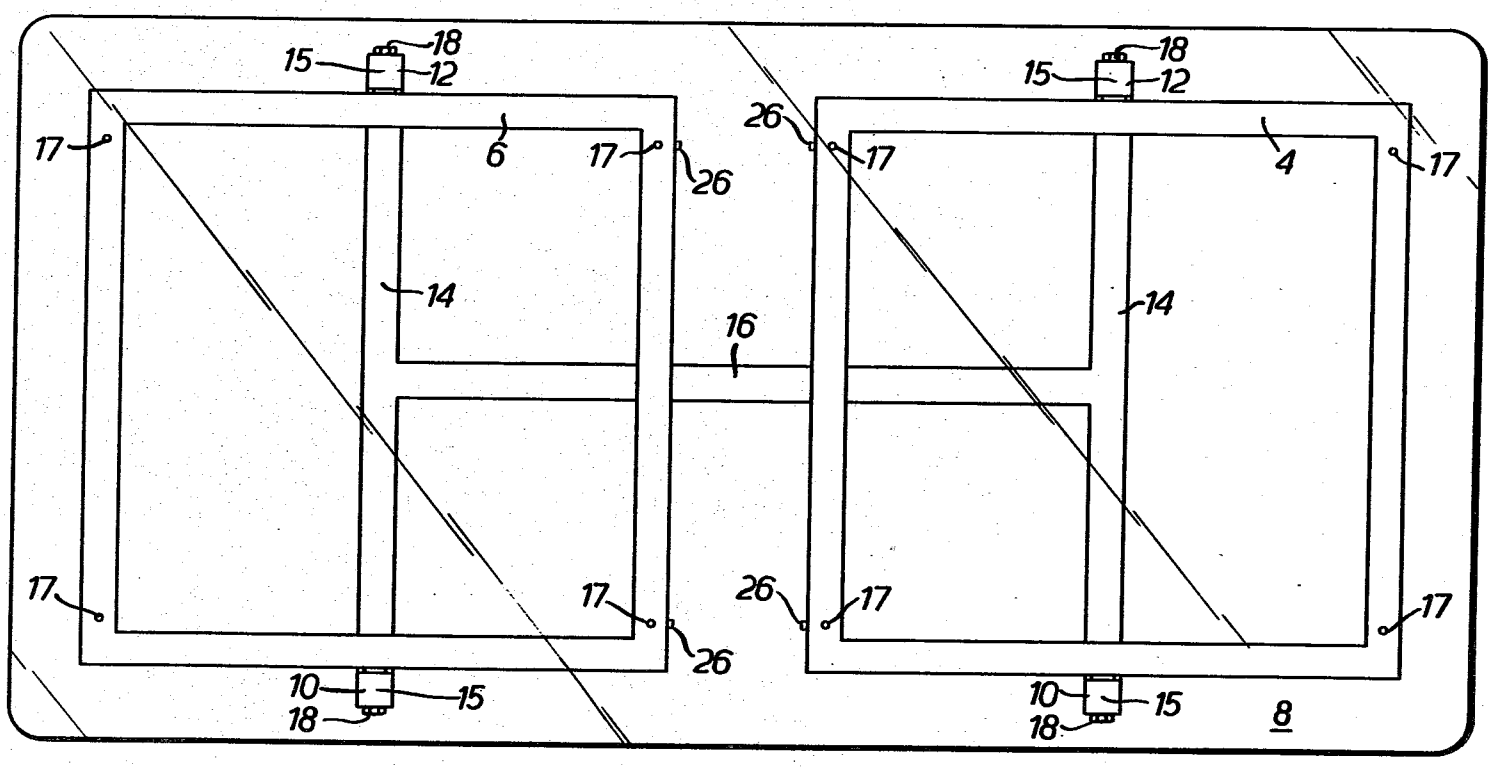
FIG. 2 is a top plan view of the table shown in FIG. 1.

Referring to FIGS. 1 and 2, there is shown an adjustable table 2 comprising a pair of square open-frame support members 4, 6 supporting a glass table top 8. The support members 4, 6 can be made of brass or chrome-covered steel tubes and the sides of the support members 4, 6 can be welded or otherwise joined together. The table 2 is also provided with a pair of upstanding legs 10, 12 at each end. Each pair of legs 10, 12 is joined by a cross bracing member 14 and the two members 14 are joined by a longitudinal bracing member 16 which is positioned at floor level. The legs 10, 12 are of the same tubular construction as the support members 4, 6 and their open tops are closed by welded cap members 15.

Figure 4:
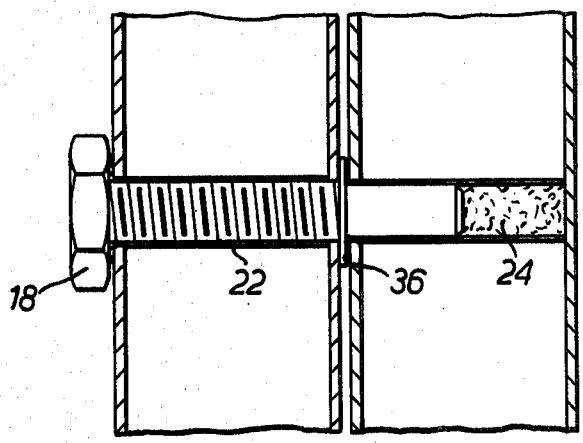
FIG. 4 is an enlarged cross-section through the upper part of a table leg and support member as shown in FIG. 3.

As shown in FIGS. 1 and 2, the support members 4, 6 are in their first position in which they support the table top 8 on clear plastics stops 17 at a first height, for example at coffee table height. The support members 4, 6 are held in this position about chrome-covered bolts 18 by virtue of the weight of the table top 8 on the support members. The heads of the bolts 18 are provided with a wide slot 20 so that they can easily be undone by a coin or the like. For assembly, each bolt 18 is screwed into a threaded sleeve 22 shown in FIG. 4, the end of the sleeve 22 being packed with grease 24 to facilitate the pivotting action of the support member 4, 6.

Figure 3:
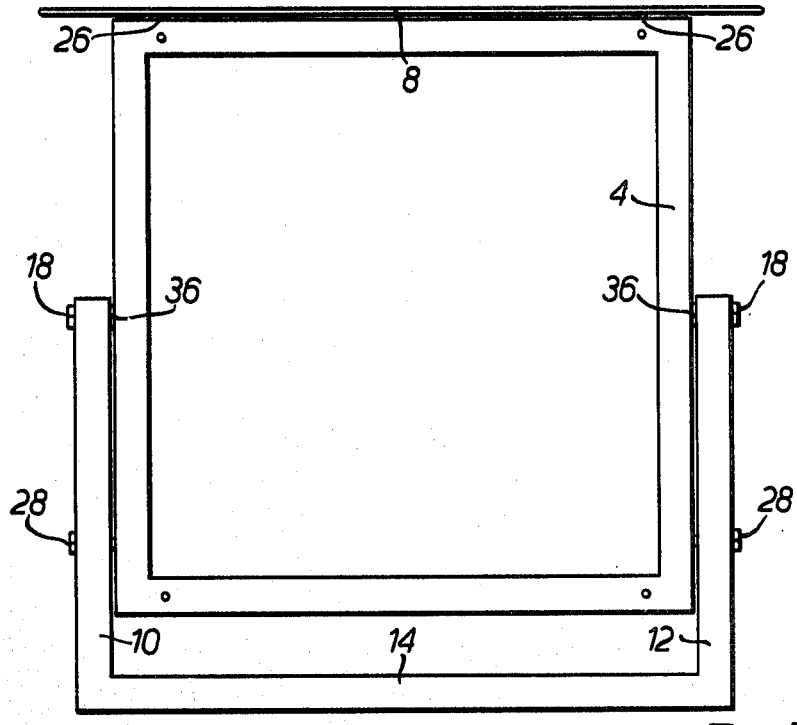
FIG. 3 is an end view of the table shown in FIG. 1 with the table top in its higher position.

The support members 4, 6 can be easily swung from their horizontal position shown in FIGS. 1 and 2 to their second and vertical position as shown in FIG. 3. The support member 4 is swung clockwise as shown in FIG. 1 and the support member 6 is swung anti-clockwise as shown in FIG. 1. In FIG. 3, the table top 8 rests on clear plastics stops 26 and the table top 8 is at its higher position which may be, for example, a dining table position.

Figure 5:
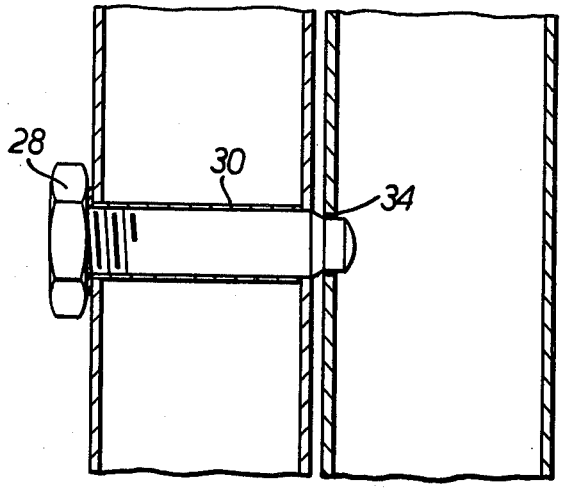
FIG. 5 is an enlarged cross-section through the lower part of a table leg and support member as shown in FIG. 3.
Figure 6:
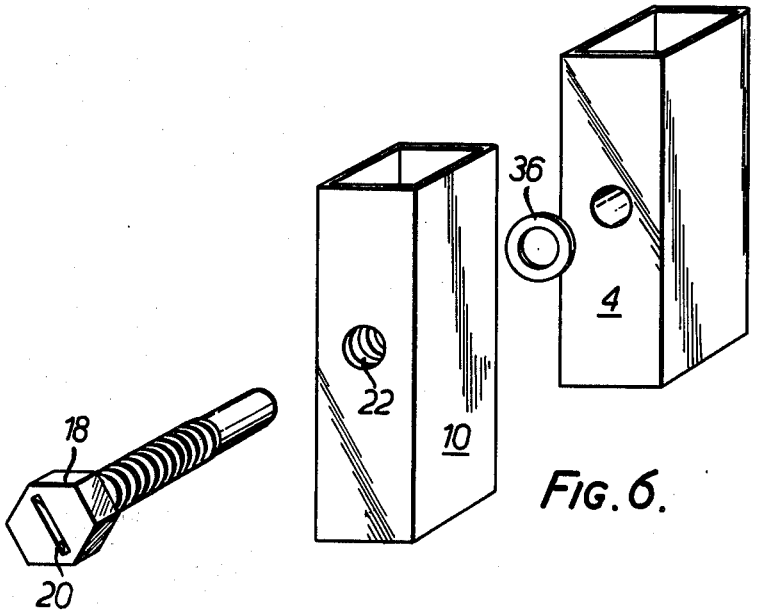
FIG. 6 is an exploded perspective view of the upper part of a table leg and support member.

The support members 4, 6 can be secured in their second and vertical position by locking means in the form of chrome-covered bolts 28 fitting in a sleeve 30 as shown in FIG. 5. The bolts 28 are provided with large slots 32 so that they can easily be screwed with a coin or the like into a hole 34 in the support members 4, 6.

The table top 8 can easily be moved between its upper and lower positions without removing the table top 8 from the support members 4, 6. Obviously, the length of the support members 4, 6 determines the exact height of the table top 8 in its upper and lower positions. The stops 17, 26 ensure that the table top 8 has only minimum contact with the support members 4, 6 so that friction is minimised in converting the table from position to position. In order to further minimise friction, a washer 36 is provided between the legs 10, 12 and the sides of the support members 4, 6.

It is to be appreciated that the embodiment of the invention described above has been given by way of example only and that modifications may be effected. Thus, for example, different table legs 10, 12 or different support members 4, 6 may be employed. The bolts 28 can be screw threaded for more than the illustrated two turns. Also, the table top 8 can be provided with a game on one or both of its surfaces, the game being for example, draughts, backgammon or chess. When the table top 8 has a game on both of its surfaces, the table 2 can be constructed such that the table top 8 can be turned completely over so that either game can be played as desired. The game, or at least the board part of the game, can extend over all or a part of the surface of the table, or if desired more than one game can be provided on each surface. As an alternative to actually providing the game or games on the table top 8, the table top 8 can be such that the game or games can be secured, for example clipped, in position on the table top 8.

I claim:

1. An adjustable table comprising a table top, a base frame positioned underneath the table top and having four fixed upstanding legs which are arranged in pairs at opposite end portions of the frame, and a support member pivotally attached to the upper end portions of each pair of legs such that it pivots between the legs, the support members being pivotable between their legs from a first position in which the support members support the table top at a first height to a second position in which the support members support the table top at a second and higher height, the support members being horizontal in their first position and vertical in their second position, the table top resting freely on the support members in an unsecured condition as the support members are moved between their first and their second positions whereby the table top remains the same way up when the support members are in their first and their second positions, and the adjustable table including locking means for locking the support members to the upstanding legs when the support members are in their second position.

2. An adjustable table according to claim 1 in which the base frame is H-shaped in plan, in which the table top is constituted by a flat sheet member, and in which each support member in its first position supports substantially half the table top, each support member being of an open frame construction.

3. An adjustable table according to claim 2 in which each support member has first table top receiving members on which the table top rests when the support members are in their first position, and second table top receiving members on which the table top rests when the support members are in their second position.

4. An adjustable table according to claim 3 in which the lock means comprises at least one bolt member for each pair of legs, the said at least one bolt member being provided on one of the said pair of legs and being movable into an aperture in an adjacent part of the support member to lock the support member in position between its pair of legs.

5. An adjustable table according to claim 4 in which the base frame and the support members are made from tubular members.

* * * * *